US010916827B2

(12) United States Patent
Maruyama et al.

(10) Patent No.: US 10,916,827 B2
(45) Date of Patent: Feb. 9, 2021

(54) WIRELESS MODULE

(71) Applicant: FUJITSU COMPONENT LIMITED, Tokyo (JP)

(72) Inventors: Kimihiro Maruyama, Tokyo (JP); Masakazu Muranaga, Tokyo (JP); Masaru Sakurai, Tokyo (JP); Tatsuya Kakehashi, Tokyo (JP)

(73) Assignee: FUJITSU COMPONENT LIMITED, Tokyo (JP)

( * ) Notice: Subject to any disclaimer, the term of this patent is extended or adjusted under 35 U.S.C. 154(b) by 42 days.

(21) Appl. No.: 16/230,330

(22) Filed: Dec. 21, 2018

(65) Prior Publication Data

US 2019/0296417 A1 Sep. 26, 2019

(30) Foreign Application Priority Data

Mar. 26, 2018 (JP) ..... 2018-059016

(51) Int. Cl.

| | |
|---|---|
| ***H01Q 1/52*** | (2006.01) |
| ***H01Q 1/12*** | (2006.01) |
| ***H01Q 1/42*** | (2006.01) |
| ***H01Q 21/06*** | (2006.01) |
| ***H01Q 9/04*** | (2006.01) |

(52) U.S. Cl.

CPC ..... *H01Q 1/12* (2013.01); *H01Q 1/42* (2013.01); *H01Q 1/526* (2013.01); *H01Q 9/0407* (2013.01); *H01Q 21/065* (2013.01)

(58) Field of Classification Search

CPC ..... H01Q 1/52; H01Q 1/42; H01Q 9/0407; H01Q 21/065; H01Q 1/2283; H01Q 1/38; H01L 23/66

See application file for complete search history.

(56) References Cited

U.S. PATENT DOCUMENTS

2009/0231225 A1* 9/2009 Choudhury ..... H01Q 3/26 343/770
2014/0140031 A1* 5/2014 Fujita ..... H05K 1/144 361/803

(Continued)

FOREIGN PATENT DOCUMENTS

JP 2006-262164 9/2006
WO WO 2016/056387 A1 4/2016

OTHER PUBLICATIONS

Japanese Platform for Patent Information English abstract corresponding to Japanese Patent Publication No. 2006-262164, published Sep. 28, 2006.

*Primary Examiner* — Hasan Z Islam
(74) *Attorney, Agent, or Firm* — Staas & Halsey LLP

(57) ABSTRACT

A wireless module including: a substrate that includes a first surface and a second surface on the back side of the first surface; a plurality of signal terminals that are provided on the first surface and the second surface, input and output signals; an antenna provided on the first surface; a signal processing circuit that is provided on the second surface, is connected between the signal terminals and the antenna, and performs various signal processings on signals input from the signal terminals and the antenna; wherein the signal terminals are arranged in horizontal symmetry on the first surface and the second surface, arranged at the same positions of the first surface and the second surface, and connected to a single signal line in the substrate.

4 Claims, 8 Drawing Sheets

(56) References Cited

U.S. PATENT DOCUMENTS

| | | | | |
|---|---|---|---|---|
| 2018/0205155 | A1* | 7/2018 | Mizunuma | H01Q 21/0025 |
| 2019/0027449 | A1* | 1/2019 | Wan | H01L 23/3135 |
| 2019/0280367 | A1* | 9/2019 | Hsu | H01Q 1/02 |
| 2020/0014113 | A1* | 1/2020 | Asaka | H01Q 9/0414 |

* cited by examiner

WIRELESS MODULE

CROSS-REFERENCE TO RELATED APPLICATION

This application is based upon and claims the benefit of priority of the prior Japanese Patent Application No. 2018-059016 filed on Mar. 26, 2018, the entire contents of which are incorporated herein by reference.

FIELD

A certain aspect of the embodiments is related to a wireless module.

BACKGROUND

FIGS. 1A and 1B are diagrams illustrating the configuration of a conventional wireless module. FIG. 1B illustrates a state where the wireless module of FIG. 1A is turned over. The wireless module of FIGS. 1A and 1B includes a first substrate 1, a shield plate 2 and a second substrate 3. Unillustrated communication circuits are formed on an upper surface of the first substrate 1 in FIG. 1A, and covered with the shield plate 2. Patch antennas 4 are provided on an upper surface of the second substrate 3. Signal pads 5 are provided on a lower surface of the first substrate 1, as illustrated in FIG. 1B. The signal pads 5 are fixed on an unillustrated mounting board by solder. Since the wireless module of FIG. 1A has a directivity directing upward vertically from an antenna surface, it is necessary to turn the antenna surface to a target.

There has been known a technique for mounting, on the mounting board with an opening, a high frequency communication module equipped with patch antennas on both its upper and lower surfaces (e.g. see International Publication Pamphlet No. 2016/056387). In this technique, it is possible to radiate radio waves from the upper and lower surfaces of the high frequency communication module.

Moreover, there has been known an in-vehicle antenna device that houses an antenna element in a housing having a mounting surface and a decorative surface as one surface and its opposed surface, and is disposed on a glass surface or a dashboard in a vehicle (e.g. see Japanese Laid-open Patent Publication No. 2006-262164).

SUMMARY

According to an aspect of the present invention, there is provided a wireless module including: a substrate that includes a first surface and a second surface on the back side of the first surface; a plurality of signal terminals that are provided on the first surface and the second surface, input and output signals; an antenna provided on the first surface; a signal processing circuit that is provided on the second surface, is connected between the signal terminals and the antenna, and performs various signal processings on signals input from the signal terminals and the antenna; wherein the signal terminals are arranged in horizontal symmetry on the first surface and the second surface, arranged at the same positions of the first surface and the second surface, and connected to a single signal line in the substrate.

The object and advantages of the invention will be realized and attained by means of the elements and combinations particularly pointed out in the claims.

It is to be understood that both the foregoing general description and the following detailed description are exemplary and explanatory and are not restrictive of the invention, as claimed.

DESCRIPTION OF EMBODIMENTS

Figure 1A:
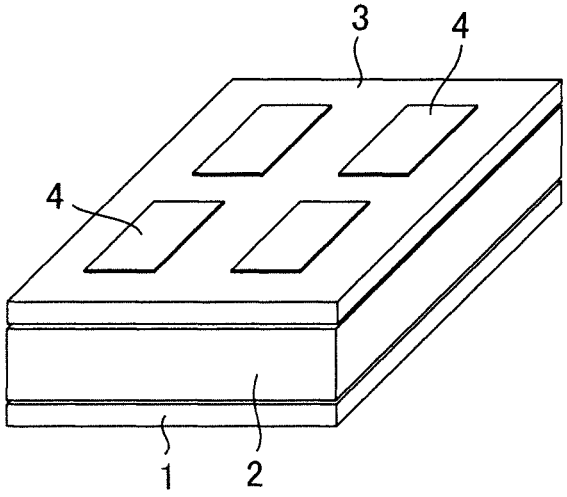
FIG. 1A RELATED ART
FIGS. 1A and 1B are diagrams illustrating the configuration of a conventional wireless module.
Figure 1B:
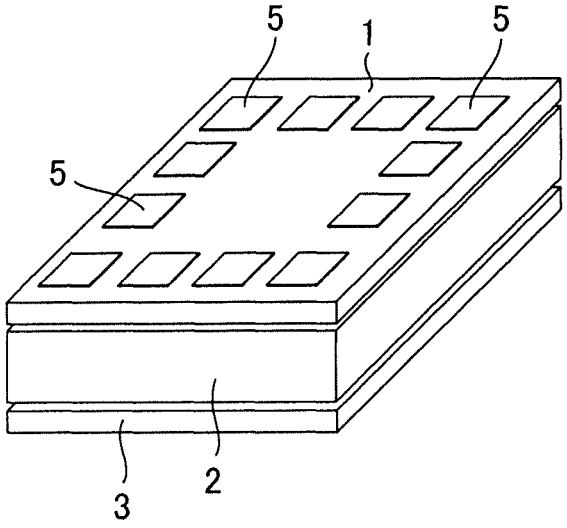
FIG. 1B RELATED ART

In the wireless module of FIGS. 1A and 1B, the signal pads 5 of the first substrate 1 must be fixed by solder on the mounting board. Therefore, when the wireless module is mounted on the mounting board, a mounting method and a mounting direction are limited to a single method and a single direction. A wireless module according to embodiments disclosed herein can provide a plurality of mounting methods and a plurality of mounting directions.

A description will now be given of an embodiment according to the present invention with reference to drawings.

Figure 2B:
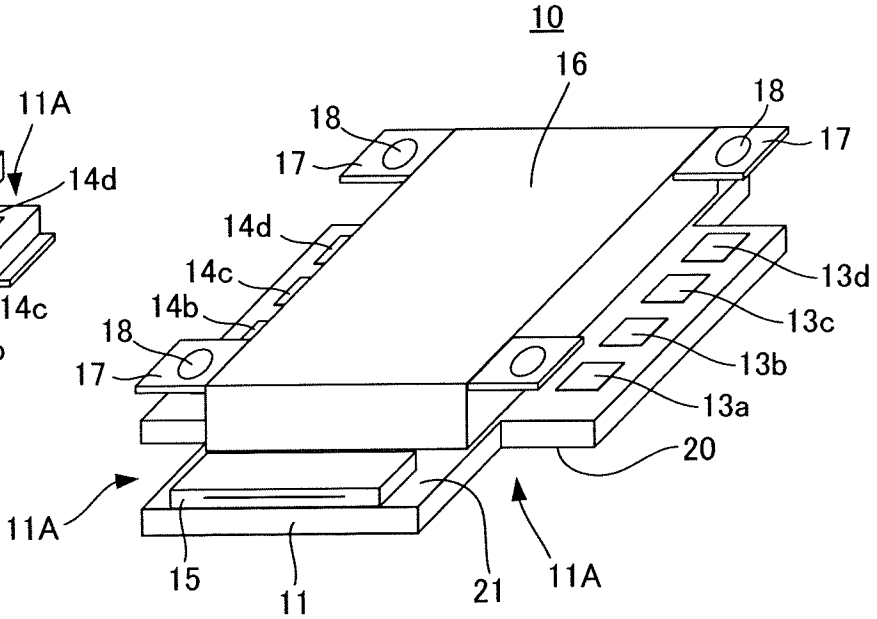
FIGS. 2A and 2B are diagrams illustrating the exterior appearance of a wireless module according to a present embodiment.
Figure 2A:
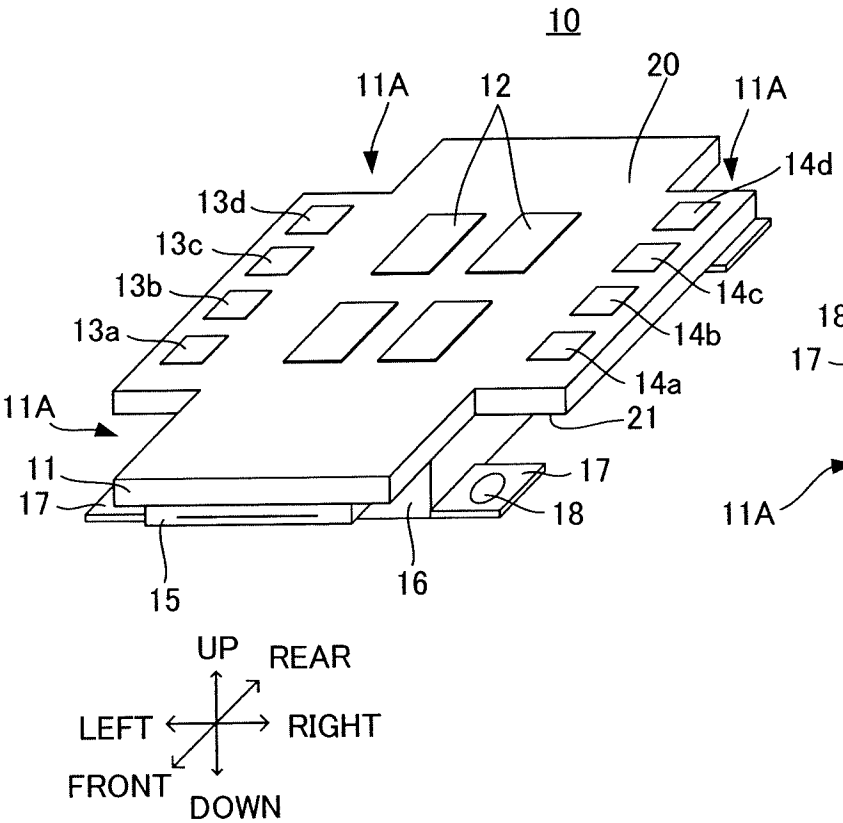
Figure 3:
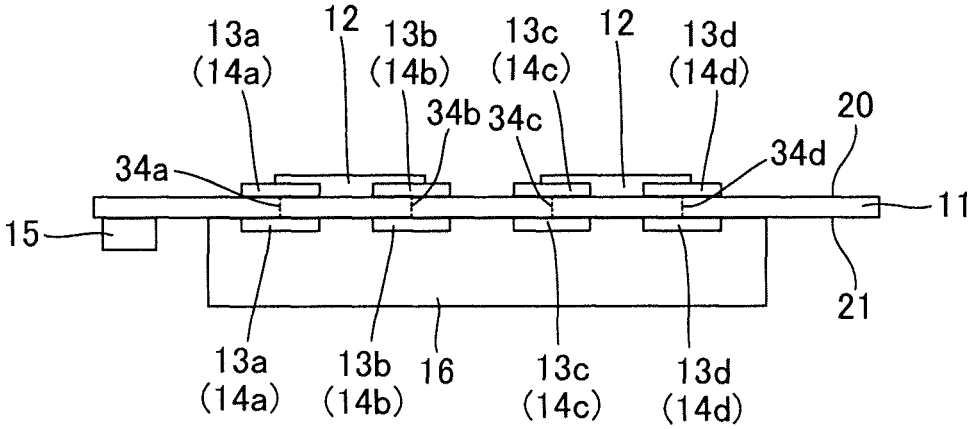
FIG. 3 is a side view of the wireless module.

FIGS. 2A and 2B are diagrams illustrating the exterior appearance of a wireless module according to a present embodiment. FIG. 2B illustrates a state where the wireless module of FIG. 2A is turned over. FIG. 3 is a side view of the wireless module. In the present embodiment, up-and-down directions, right-and-left directions, and front-and-rear directions are defined as illustrated in FIG. 2A. In FIG. 2B, the up-and-down directions and the right-and-left directions are reversed compared to FIG. 2A.

A wireless module 10 of FIGS. 2A and 2B includes a substrate 11, a connector 15 and a shield case 16. Although the substrate 11 is a cross shape in the top view, the shape of the substrate 11 is not limited thereto. A plurality of patch antennas 12 are provided in the center of an upper surface 20 of the substrate 11.

A plurality of signal pads 13*a*-13*d* and 14*a*-14*d* as signal terminals are provided on the right and left ends of the upper surface 20, respectively. The signal pads 13*a*-13*d* and 14*a*-14*d* are fixed on signal pads of a mounting board by solder, as described later.

As illustrated in FIG. 3, the signal pads 13*a*-13*d* and 14*a*-14*d* are provided on not only the upper surface 20 (i.e., a first surface) but also a lower surface 21 (i.e., a second surface) of the substrate 11. The signal pads 13*a*-13*d* of the upper surface 20 are electrically connected to the signal pads 13*a*-13*d* of the lower surface 21 via signal lines 34*a*-34*d* inside the substrate 11, respectively. The signal pads 14*a*-

14*d* of the upper surface 20 are electrically connected to the signal pads 14*a*-14*d* of the lower surface 21 via the signal lines 34*a*-34*d* inside the substrate 11, respectively. Here, the number of the signal pads is not limited to examples of FIGS. 2A, 2B and 3.

The connector 15 is provided at a front end of the lower surface 21 of the substrate 11. The connector 15 is, for example, a FPC (Flexible printed circuit) connector, a stacking connector or a DIP connector.

The shield case 16 for covering wireless communication circuits described later to shield an electromagnetic wave is provided in the center of the lower surface 21 of the substrate 11. The shield case 16 is in the shape of a box. Fixing portions 17 for fixing the shield case 16 on a jig or a product housing are provided on four corners of a lower end of the shield case 16. Each of the fixing portions 17 has a thin plate shape extending horizontally, and has a wettability of the solder to fix each fixing portion 17 on the jig or the product housing by solder. Moreover, the fixing portion 17 has a screw hole 18 for screwing the shield case 16 to the jig or the product housing. The fixing portion 17 preferably has at least one of the solder wettability and the screw hole 18. Here, in view of screwing, the cutout portions 11A are provided at the four corners of the substrate 11 so that the four corners of the substrate 11 do not overlap with the fixing portions 17 in the top view.

Figure 4:
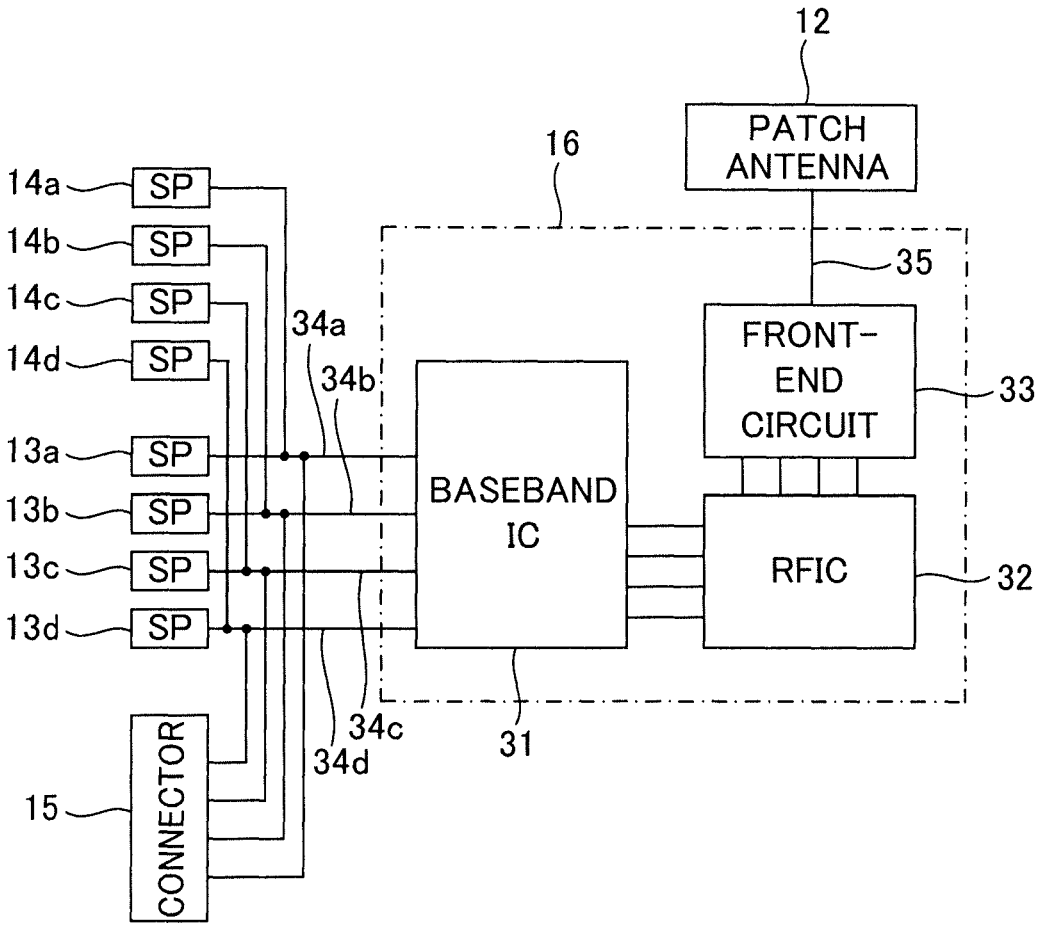
FIG. 4 is a block diagram illustrating the configuration of the wireless module.

FIG. 4 is a block diagram illustrating the configuration of the wireless module 10.

A baseband IC 31 for wireless control, a RFIC 32 for generation of wireless signals, and a front-end circuit 33 are provided in the center of the lower surface 21 of the substrate 11. The baseband IC 31 handles signals before modulation or after demodulation, the RFIC 32 generates wireless signals by modulating or demodulating the signals from the baseband IC 31, and the front-end circuit 33 transmits, receives and amplifies the wireless signals. The baseband IC 31, the RFIC 32 and the front-end circuit 33 serve as signal processing circuits that perform various signal processings on the signals input from the plurality of signal pads 13*a*-13*d* and 14*a*-14*d*, and the patch antenna 12. The baseband IC 31, the RFIC 32 and the front-end circuit 33 are housed in the shield case 16.

The baseband IC 31 are connected to the signal pads 13*a*-13*d* and 14*a*-14*d* and the connector 15 via the signal lines 34*a*-34*d*, and transmits and receives the signals before modulation or after demodulation. Moreover, the baseband IC 31 is connected to the RFIC 32. The RFIC 32 is connected to the front-end circuit 33. The front-end circuit 33 is connected via a signal line 35 to the patch antenna 12 for transmitting and receiving the wireless signals as radio waves. Since the patch antenna 12 is provided on the upper surface 20 and the front-end circuit 33 is provided on the lower surface 21, the signal line 35 is disposed inside the substrate 11.

The signal pads 13*a* and 14*a* are connected to the signal line 34*a*, and the signal pads 13*b* and 14*b* are connected to the signal line 34*b*. The signal pads 13*c* and 14*c* are connected to the signal line 34*c*, and the signal pads 13*d* and 14*d* are connected to the signal line 34*d*. The connector 15 is connected to the signal lines 34*a*-34*d*. Here, the signal lines 34*a*-34*d* are provided inside the substrate 11.

Figure 5:
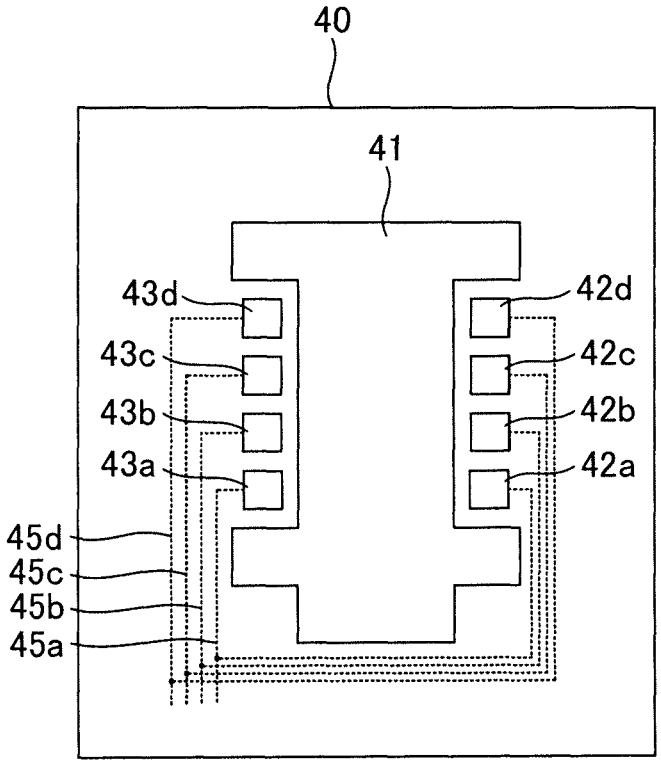
FIG. 5 is a diagram illustrating the configuration of a mounting board on which the wireless module is to be mounted.

FIG. 5 is a diagram illustrating the configuration of a mounting board 40 on which the wireless module 10 is to be mounted.

The mounting board 40 includes a through hole 41 capable of inserting the shield case 16 of the wireless module 10 therein, and signal pads 42*a*-42*d* and 43*a*-43*d* to be fixed with the signal pads 13*a*-13*d* and 14*a*-14*d* by solder. The signal pads 42*a* and 43*a* are connected to a signal line 45*a* inside the mounting board 40, and the signal pads 42*b* and 43*b* are connected to a signal line 45*b* inside the mounting board 40. The signal pads 42*c* and 43*c* are connected to a signal line 45*c* inside the mounting board 40, and the signal pads 42*d* and 43*d* are connected to a signal line 45*d* inside the mounting board 40.

Figure 6B:
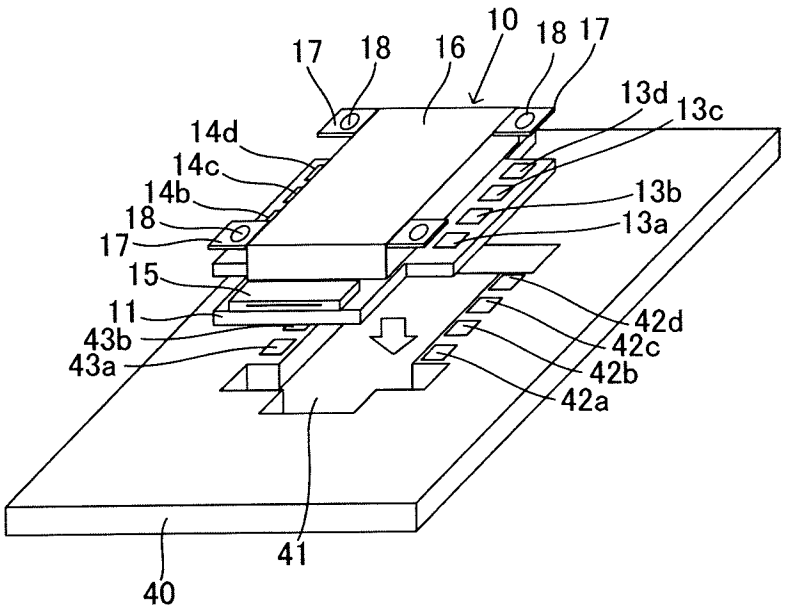
FIGS. 6A and 6B are diagrams illustrating states where the wireless module is mounted on the mounting board.
Figure 6A:
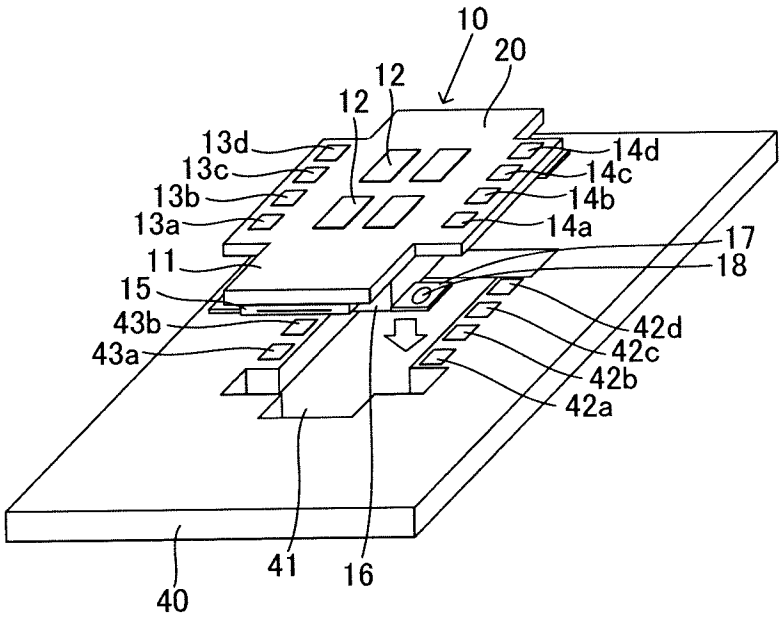

FIGS. 6A and 6B are diagrams illustrating states where the wireless module 10 is mounted on the mounting board 40. In FIG. 6A, the wireless module 10 in a state of FIG. 2A is mounted on the mounting board 40. In FIG. 6B, the wireless module 10 in a reversed state of FIG. 2B is mounted on the mounting board 40.

In FIG. 6A, the connector 15 and the shield case 16 including the fixing portions 17 are inserted into the through hole 41. Thereby, the total thickness of the wireless module 10 and the mounting board 40 is reduced, which enables to reduce the height thereof. In case of FIG. 6A, the directivity of the patch antennas 12 is upward.

A left end of the substrate 11 provided with the signal pads 13*a*-13*d* and a right end of the substrate 11 provided with the signal pads 14*a*-14*d* are in contact with a part of the mounting board 40 without being inserted into the through hole 41. The signal pads 13*a*-13*d* are electrically conducted with the signal pads 43*a*-43*d* on the mounting board 40 by solder, respectively. The signal pads 14*a*-14*d* are electrically conducted with the signal pads 42*a*-42*d* on the mounting board 40 by solder, respectively.

On the contrary, in FIG. 6B, the right end of the substrate 11 provided with the signal pads 13*a*-13*d* and the left end of the substrate 11 provided with the signal pads 14*a*-14*d* are in contact with a part of the mounting board 40. Therefore, the connector 15 and the shield case 16 including the fixing portions 17 are not inserted into the through hole 41. In case of FIG. 6B, the directivity of the patch antennas 12 is downward. Since the patch antennas 12 are inserted into the through hole 41, the patch antennas 12 projecting slightly from the upper surface 20 can be hidden from the outside.

In case of FIG. 6B, the signal pads 13*a*-13*d* are electrically conducted with the signal pads 42*a*-42*d* on the mounting board 40 by solder, respectively. The signal pads 14*a*-14*d* are electrically conducted with the signal pads 43*a*-43*d* on the mounting board 40 by solder, respectively.

In this way, in the wireless module 10, the signal pads 13*a* and 14*a*, 13*b* and 14*b*, 13*c* and 14*c* and 13*d* and 14*d* are arranged in horizontal and vertical symmetry on the substrate 11, and the signal pads arranged in horizontal and vertical symmetry are connected to the single common signal line 34*a* (34*b*-34*d*) in the substrate 11, so that two antenna directivities can be achieved. Here, the arrangement in vertical symmetry of the signal pads indicates that the signal pads are arranged at the same positions of the upper surface 20 and the lower surface 21 of the substrate 11. Also in the mounting board 40, the signal pads 42*a* and 43*a* (42*b* and 43*b*, 42*c* and 43*c*, or 42*d* and 43*d*) are arranged in horizontal symmetry, and the signal pads arranged in horizontal symmetry are connected to the single common signal line 45*a* (45*b*-45*d*) in the mounting board 40, so that it is possible to assist the achievement of two antenna directivities.

Figure 7A:
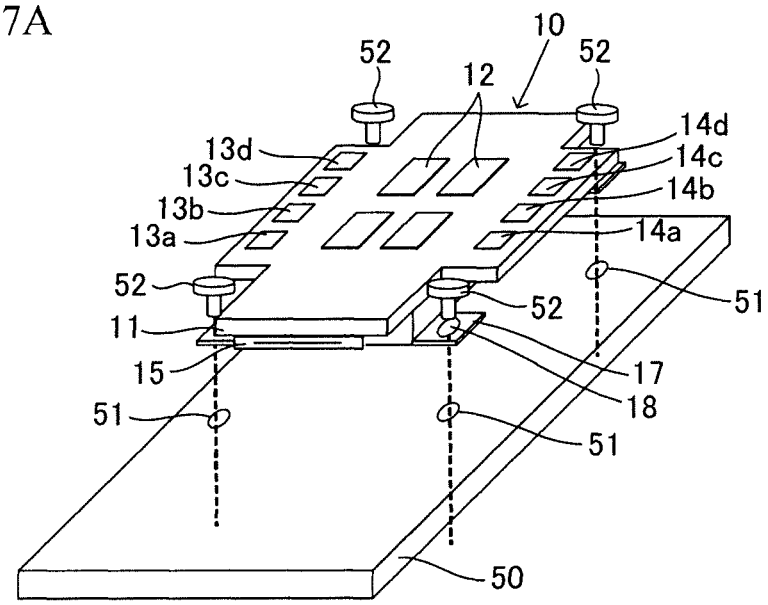
FIG. 7A is a diagram illustrating a state where the wireless module is mounted on a product housing.
Figure 7B:
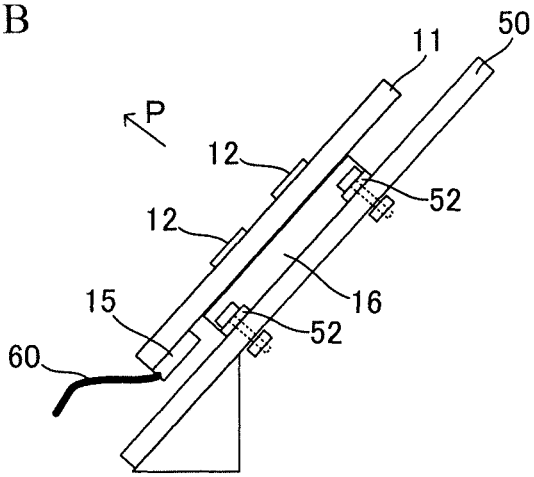
FIGS. 7B and 7C are side views of the product housing on which the wireless module is mounted.
Figure 7C:
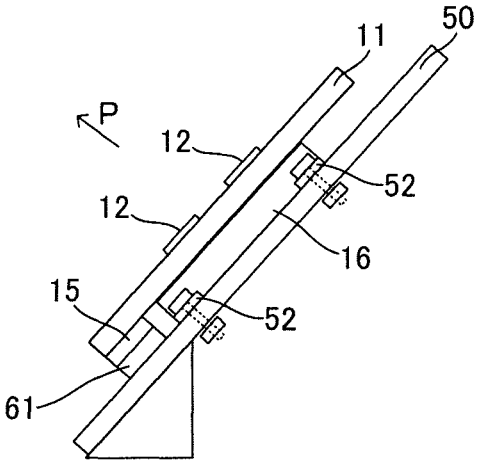

FIG. 7A is a diagram illustrating a state where the wireless module 10 is mounted on the product housing. FIGS. 7B and 7C are side views of the product housing on which the wireless module 10 is mounted.

When a product housing 50 other than the mounting board 40 includes screw holes 51 as illustrated in FIG. 7A, the wireless module 10 can be screwed to the product housing 50 with screws 52. In this case, the screws 52 are inserted into the screw holes 18 and the screw holes 51, and the shield case 16 is fixed to the product housing 50. Here, the material of the product housing 50 is any one of plastic, resin, metal or the like. Moreover, the wireless module 10 may be screwed to the jig.

When the connector 15 is the FPC connector, a FPC cable 60 is connected to the connector 15 as illustrated in FIG. 7B. In this case, the signals are input and output via the connector 15 without using the signal pads 13*a*-13*d* and 14*a*-14*d*. The directivity of the patch antennas 12 is a P-direction of FIG. 7B.

When the connector 15 is a male or female connector of the stacking connector as illustrated in FIG. 7C, the connector 15 is inserted into a female or male connector of a stacking connector 61 provided on the product housing 50. Also in this case, the signals are input and output via the connector 15 without using the signal pads 13*a*-13*d* and 14*a*-14*d*. The directivity of the patch antennas 12 is the P-direction of FIG. 7C.

Here, the fixing portion 17 has the wettability of the solder as described above, and the shield case 16 therefore may be fixed to the product housing 50 by solder.

Figure 8:
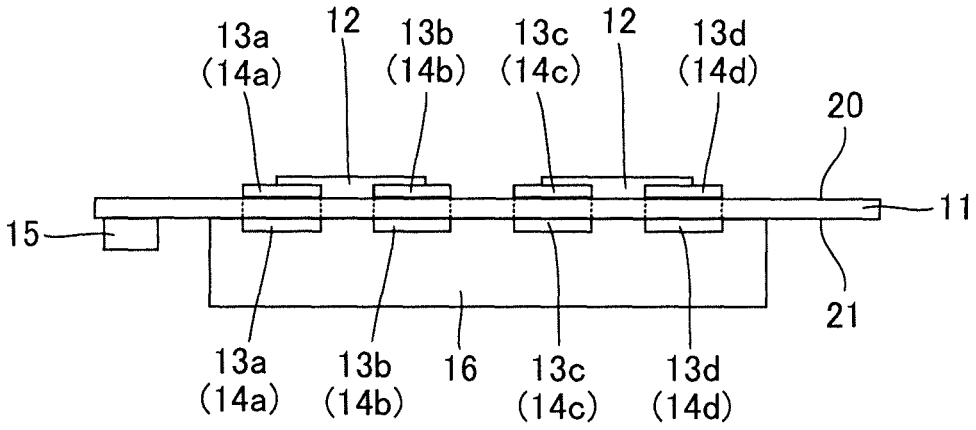
FIG. 8 is a side view illustrating a variation of the wireless module.

FIG. 8 is a side view illustrating a variation of the wireless module 10.

In FIG. 3, the signal pads 13*a*-13*d* and 14*a*-14*d* are provided on the upper surface 20 and the lower surface 21 of the substrate 11. However, the single signal pad 13*a* (13*b*-13*d*) having a larger thickness than the thickness of the substrate 11 may be arranged so as to protrude from the upper surface 20 and the lower surface 21 of the substrate 11, as illustrated in FIG. 8. That is, the signal pad 13*a* located above the upper surface 20 may penetrate the substrate 11 and be integrated with the signal pad 13*a* located below the lower surface 21. In this case, no signal line in the substrate 11 for connecting the signal pad 13*a* located above the upper surface 20 and the signal pad 13*a* located below the lower surface 21 is required.

As described above, according to the present embodiment, the plurality of signal pads 13*a* and 14*a*, 13*b* and 14*b*, 13*c* and 14*c* or 13*d* and 14*d* are arranged in horizontal symmetry on the upper surface 20 and the lower surface 21, arranged at the same positions of the upper surface 20 and the lower surface 21, and connected to the single signal line in the substrate 11. Therefore, the wireless module 10 can be mounted on the mounting board 40 in a state where the directivity of the patch antennas 12 is upward or downward, as illustrated in FIG. 6A or 6B. Accordingly, the wireless module 10 can provide a plurality of mounting methods and a plurality of mounting directions.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiments of the present invention have been described in detail, it should be understood that the various change, substitutions, and alterations could be made hereto without departing from the spirit and scope of the invention.

What is claimed is:

1. A wireless module comprising:

a substrate that includes a first surface and a second surface on a back side of the first surface;

a plurality of signal terminals for inputting and outputting signals that are provided on the first surface and the second surface;

coplanar patch antennas provided on the first surface;

a signal processing circuit that is provided on the second surface, the signal processing circuit is electrically connected between the plurality of signal terminals and the patch antennas;

a shield case that covers the signal processing circuit, and includes a fixing portion for fixing the wireless module to a member;

wherein the plurality of signal terminals are arranged in horizontal symmetry on the first surface and the second surface, arranged at respective same positions of the first surface and the second surface, and connected to a single signal line in the substrate, wherein the substrate includes a cutout portion so as not to overlap with the fixing portion.

2. The wireless module as claimed in claim 1, wherein a signal terminal of the plurality of the signal of the signal terminals on the first surface penetrates the substrate, and is integrated with another signal terminal of the plurality of signal terminals on the second surface.

3. The wireless module as claimed in claim 1, further comprising:

a connector on the second surface and connected to the single signal line.

4. A wireless module comprising:

a substrate that includes a first surface and a second surface on a back side of the first surface;

a plurality of signal terminals for inputting and outputting signals that are provided on the first surface and the second surface;

an antenna provided on the first surface;

a signal processing circuit that is provided on the second surface, connected between the plurality of signal terminals and the antenna, for performing various signal processings on signals input from the plurality of signal terminals and the antenna;

a shield case that covers the signal processing circuit, and includes a fixing portion for fixing the wireless module to a member;

wherein the plurality of signal terminals are arranged in horizontal symmetry on the first surface and the second surface, arranged at respective same positions of the first surface and the second surface, and connected to a single signal line in the substrate, wherein the substrate includes a cutout portion so as not to overlap with the fixing portion.

* * * * *